United States Patent [19]

Crouse

[11] 4,231,272

[45] Nov. 4, 1980

[54] TRIM CHUTE AND METHOD

[75] Inventor: Jere W. Crouse, Beloit, Wis.

[73] Assignee: Beloit Corporation, Beloit, Wis.

[21] Appl. No.: 949,788

[22] Filed: Oct. 10, 1978

[51] Int. Cl.[3] ..... B65H 35/02; B65H 29/24

[52] U.S. Cl. ..... 83/98; 83/402; 226/97

[58] Field of Search ..... 83/98, 99, 402; 226/97

[56] References Cited

U.S. PATENT DOCUMENTS

| | | | |
|---|---|---|---|
| 2,618,817 | 11/1952 | Slayter | 83/98 X |
| 2,846,004 | 8/1958 | Fotland | 83/402 X |
| 3,094,744 | 6/1963 | Renoux | 226/97 X |
| 3,192,845 | 7/1965 | Schmidt | 226/97 X |
| 3,252,366 | 5/1966 | Karr | 83/98 |
| 3,286,896 | 11/1966 | Kinney | 226/97 |
| 3,756,527 | 9/1973 | Collins | 226/97 X |
| 4,110,876 | 9/1978 | Weiss | 226/97 X |

FOREIGN PATENT DOCUMENTS

| | | | |
|---|---|---|---|
| 840930 | 1/1939 | France | 83/98 |
| 970871 | 9/1964 | United Kingdom | 226/97 |

*Primary Examiner*—J. M. Meister

*Attorney, Agent, or Firm*—Hill, Van Santen, Steadman, Chiara & Simpson

[57] ABSTRACT

Trim strip from a web slitter is received in a chute passageway which guides the trim strip away from the slitter. Low velocity air is supplied in the passageway to provide air lubrication between the chute structure and both opposite faces of the trim strip which thereby floats away from the slitter smoothly and efficiently.

23 Claims, 5 Drawing Figures

TRIM CHUTE AND METHOD

This invention relates to improvements in the handling of trim strip severed by slitter from the margin of a travelling web.

Trim slitters commonly embody an upper slitter knife and a lower slitter band and means for handling the strip trimmed from the margin of the travelling web.

A fairly successful device for handling the trim strip is disclosed in Karr U.S. Pat. No. 3,252,366, according to which the trim strip is received in a chute and assisted in travel away from the slit by means of high velocity air jets directly impinging the strip at spaced intervals longitudinally from the chute wall underlying the strip as the strip passes obliquely downwardly in the chute. When the air velocity relative to speed of travel of the trim strip is carefully regulated and maintained in proper adjustment, the apparatus of the patent functions acceptably. However, the system is susceptible of maladjustment due to improper or inexperienced or careless attention or maintenance, and the air pressure may be too high or too low or may be permitted to fluctuate undesirably. Sometimes, bunching or hang-up of the trim strip has occurred, and improper adjustment may result in flutter with attendant noise and likelihood of at least whipping against the opposite side of the chute from that at which the high velocity air jets are released toward the strip.

A principal object of the present invention is to overcome the problems mentioned and to provide substantial improvements which will attain utmost trim handling advantage in a trim chute of the general type disclosed in said U.S. Pat. No. 3,252,366.

Accordingly, the present invention provides a trim chute assembly for receiving trim strip severed by a slitter from the margin of a travelling web, comprising chute means defining a passageway for guiding the trim strip along a path away from the slitter, and means for supplying low velocity lubricating air layers along said path between said chute means and both opposite faces of the trim strip for effecting flotation of the strip and facilitating movement of the strip away from the slitter along said path.

Also according to the present invention, there is provided a method of facilitating movement in a trim chute passageway of trim strip severed by a slitter from the margin of a travelling web, comprising guiding the trim strip away from the slitter along a path in said passageway, and along said path supplying low velocity lubricating air layers between the chute and both opposite faces of the trim strip and effecting flotation of the strip and facilitating movement of the strip along said path and away from the slitter.

Other objects, features and advantages of the invention will be readily apparent from the following description of certain representative embodiments thereof, taken in conjunction with the accompanying drawings although variations and modifications may be effected without departing from the spirit and scope of the novel concepts embodied in the disclosure and in which.

Figure 1:
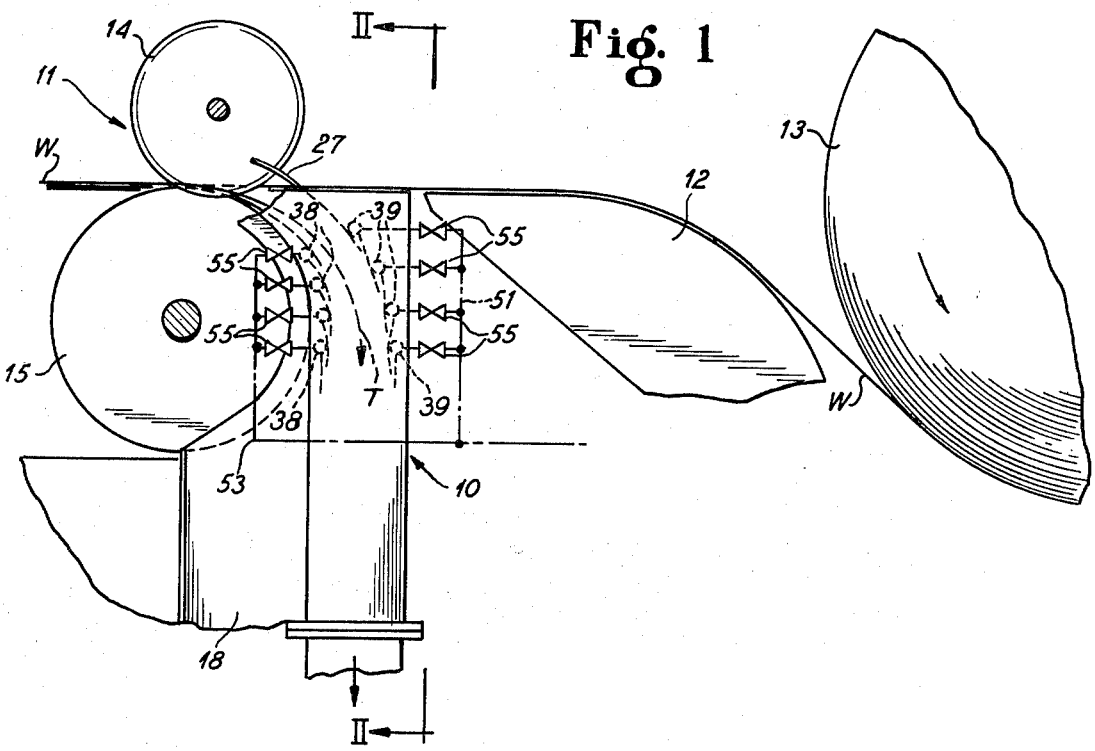
FIG. 1 is a schematic side elevational view showing a trim chute embodying the invention associated with a slitter mechanism.
Figure 2:
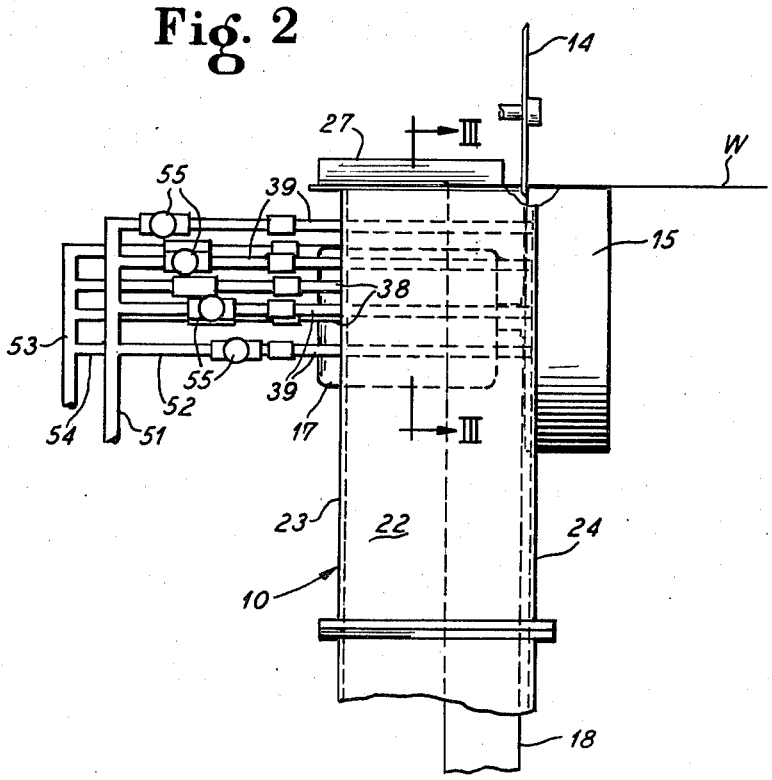
FIG. 2 is a fragmental, schematic vertical sectional detail view taken substantially along the line II—II in FIG. 1.

On reference to FIGS. 1 and 2, a trim chute 10 embodying the invention is operatively associated with a slitter 11 for trimming a marginal strip T from a travelling web W such as a paper web which after trimming passes over a guide 12 to a winder drum 13 to be wound into a roll (not shown).

As shown, the slitter 11 comprises a rotary slitter knife 14 with which is cooperatively related a lower slitter band 15 driven by a motor 17 carried by a framework 18 on which the trim chute 10 is also desirably mounted. Through this arrangement, the trim chute 10 is efficiently positioned in accordance with the positioning of the slitter band 15.

Figure 3:
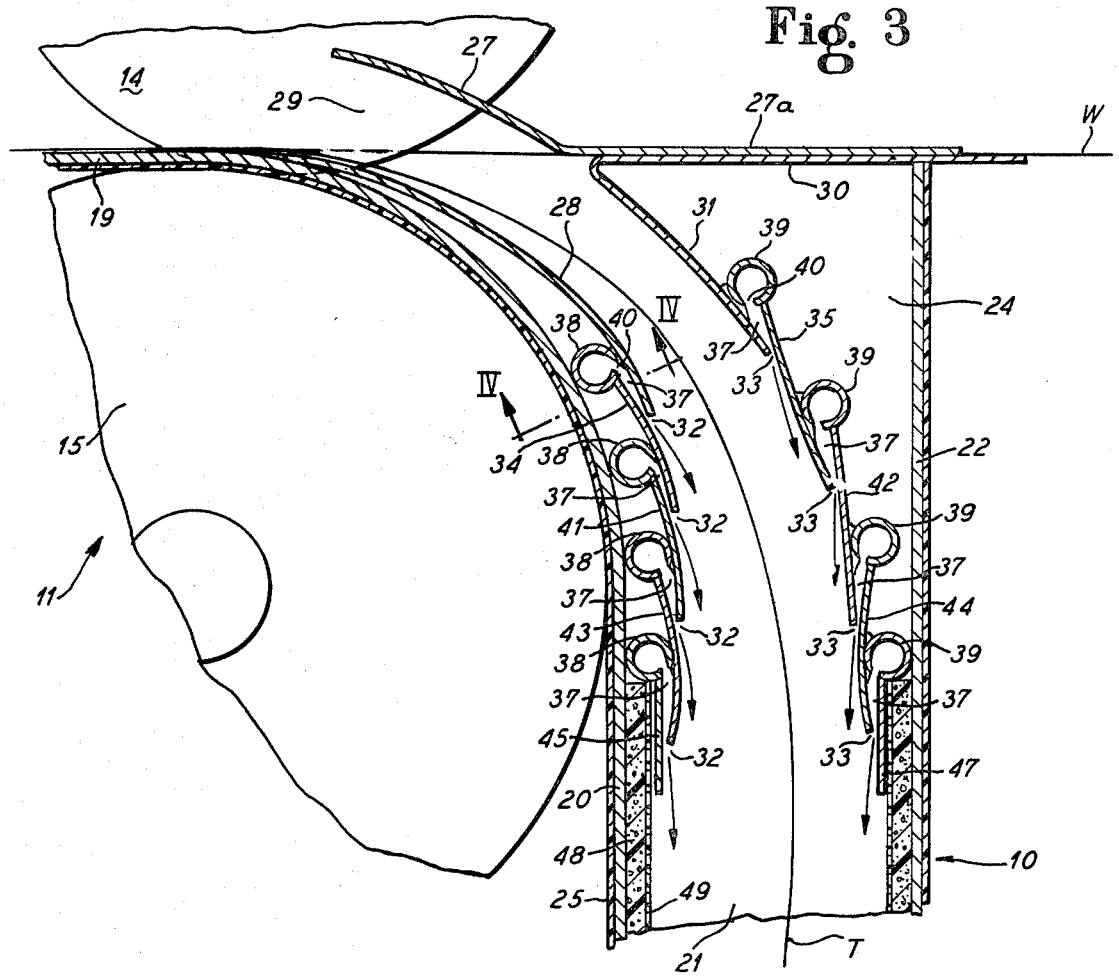
FIG. 3 is an enlarged fragmentary sectional detail view taken substantially along the line III—III of FIG. 2.

In a desirable construction, the trim chute 10 comprises a duct leading generally downwardly away from the slitter 11 and has on its upper end means for guiding the trim strip T efficiently into the top of the chute for further guidance downwardly in the chute to a suitable disposal point (not shown). To this end, a table 19 supports the web margin as it approaches the slitter 11, and beyond the slitter turns arcuately downwardly to provide a rear wall 20 of the chute extending across the width of a passageway 21 defined by front wall 22 coextensive in width and spaced from the rear wall 20, respective opposite spaced side walls 23 and 24 completing the chute passageway enclosure. By preference, the outer surfaces of the chute walls are coated with means such as leaded vinyl material 25 (FIG. 3).

To facilitate entry of the trim strip T into the upper end of the chute passageway 21, a lead-in baffle flange 27 extends in spaced relation to the downwardly curving portion of the table 19 and projects on a complementary arc substantially parallel to an underlying downwardly curved guide plate 28 defining with the baffle flange 27 a throat 29 through which the trim strip T is received and guided into the passageway 21.

As shown, the guiding baffle 27 may be mounted on the top of the chute 10 by means of a horizontal base plate **27*a*, and a supporting plate 30 may underlie the plate 27*a* to carry a downward extension guide plate 31 aligned with and of desirably the same large radius arc as the baffle 27. The guiding baffle 27 may be adjusted to change the opening to the throat 29. At its lower end, the guide baffle 31 is generally aligned with the lower end of the guide member 28 and flares slightly whereby to increase the front to rear dimension of the throat 29**.

Means are provided for supplying low velocity lubricating air layers between the front and rear wall surfaces defining the passageway 21 of the chute means and both opposite faces of the trim strip T as the strip moves along a path in the passageway 21, for effecting flotation of the strip and facilitating movement of the strip away from the slitter along such path free from contact with the front and rear wall surfaces. For smooth, efficient, substantially turbulence-free supplying of the lubricating air layers, the air is directed to issue from the slots 32 and 33 at the respective rear and front wall surfaces of the passageway 21, the slots extending substantially entirely across the path of travel of the trim strip T. For example, where the width of the chute 10 between the side walls 23 and 24 is from 5 to 6 inches, the length of the air slots 32 and 33 is desirably about the same. For high speed operation such as 4,000 to 5,000 feet per minute, a plurality of the slots 32 and 33 is provided spaced progressively downstream from one another. For example, in the illustrated example, four of the air slots 32 have been provided at spaced intervals in downstream direction, and a like number of the slots 33 has been provided. Desirably, the slots 32 are substantially aligned in a front to rear direction with the counterpart slots 33, taking into consideration the arcuate configuration of the throat 29. This assures a substantially stable action of the air supplied through the slot in the lubricating air layers.

Best results are attained where the slots 32 and 33 are oriented to enhance the coanda effect of the air as it issues from the orifices defined by the slots and biased generally toward respectively the front and rear surfaces defining the passageway 21. To this end, the air slots 32 and 33 are directed in a downstream direction, and beyond the exit of each of the slots there is a smooth surface extending downstream to the next adjacent slot in each series of slots. Thus, where slot orifices are in part defined by the respective lower ends of the plates 28 and 31, as shown, an orifice defining and coanda effect plate 34 cooperates with the plate 28 to provide the first, uppermost air slot 32 in that series. To the same effect, an orifice defining and coanda effect plate 35 cooperates with the lower end of the guide plate 31 to provide the first, uppermost air slot 33 in that series. Not only do substantial portions of the plates 34 and 35 project downwardly beyond the respective orifice slots 32 and 33, but upwardly extending portions of the plates 34 and 35 extend in divergent relation to the opposed portions of the plates 28 and 31, whereby to provide air stabilizing and distribution chambers 37 to assure smooth uniform delivery of air to the orifice slots 32 and 33 from a suitable source such as a compressor or compressed air line by way of respective delivery manifold ducts 38 and 39 each of which in the embodiment shown in FIGS. 3 and 4 has a slot port 40 which opens into the respective chambers 37 leading to the respective orifice slots 32 and 33. Where the orifice slots 32 and 33 are about 1/32 inch wide, the slot ports may be about 1/16 inch wide.

Each of the orifice slots 32 and 33 which is located below the uppermost of the orifice slots which are defined in part by the lower ends of the plates 28 and 31, is defined by and between cooperating orifice defining and coanda effect plates. Accordingly, the second orifice slots 32 and 33 in each series are defined respectively by the lower ends of the plates 34 and 35 and subjacent similar plates 41 and 42 while the next succeeding orifice slots 32 and 33 are respectively defined between the lower ends of the plates 41 and 42 and similar subjacent plates 43 and 44. The lowermost of the orifice slots 32 and 33 are defined between the lower ends of the plates 43 and 44 and subjacent orifice defining and coanda effect plates 45 and 47, respectively. Each of the plates 41, 43 and 45 not only has an upper portion which with the superjacent orifice defining and coanda effect plate defines one of the respective chambers 37, but also has an upper edge fixed to the associated air delivery duct 38, similarly as the relationship of the uppermost plate 34 and its associated delivery duct 38. To the same effect, the cooperating plates 35 and 42, as well as plates 42 and 44, and plates 44 and 47 cooperate to provide respective ones of the air stabilizing and distribution chambers 37. At their upper ends, the plates 42, 44 and 47 fixedly secured to respective air delivery ducts 39, similarly as is true of the upper plate 35. All of the plates and ducts are adapted to be secured in the assembly by means suitable for the material from which the parts are made, such as by welding, brazing, chemical bonding, and the like.

In the preferred arrangement, the throat 29 starting at least with that portion of the throat between the plates 28 and 31 and continuing to the lowermost plates 45 and 47 progressively enlarges in the front to rear direction as the throat curves down to the vertical portion of the passage 21. Thereby, as the volume of air in the lubricating air layers progressively increases in the passageway by addition of air from the successive orifice ports or slots 32 and 33, a substantially uniform, steady, stable downstream biasing pressure will be maintained on the trim strip T. Furthermore, by having the lower plate edges exposed within the throat or passageway neatly convergently related to the subjacent plates, the cushioning, lubricating air layers are biased generally toward and downwardly along the front and rear chute passage wall surfaces substantially parallel to the travelling web faces with enhanced coanda effect and disturbances in the lubricating air layers are avoided, and smooth air flow assured in the lubricating air layers.

Although trim strip flutter noise is substantially avoided, air issuing through the narrow slots 32 and 33, which in a typical installation may be about 1/32 inch wide, may generate some hissing sound even though relatively low velocity is maintained, typically at about the same speed or slightly greater than the speed of travel of the trim strip T. For example, where the web W and therefore the trim strip T pass through the slitter 11 at about 4000 to 5000 feet per minute, the air velocity should be substantially the same. Therefore, it may be desirable to line the inner surfaces of the walls defining the chute 10 with sound deadening or absorbing material such as acoustical foam 48 having the inner surface protected by means such as perforated metal 49. At its upper end, the soundproofing material 48 desirably extends at least up behind the plates 45 and 47.

Figure 4:
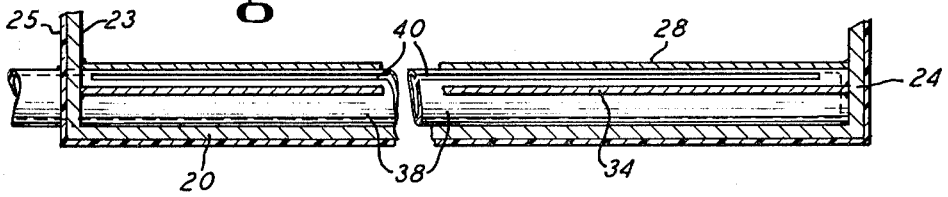
FIG. 4 is a fragmentary sectional detail view taken substantially along the line IV—IV of FIG. 3.
Figure 5:
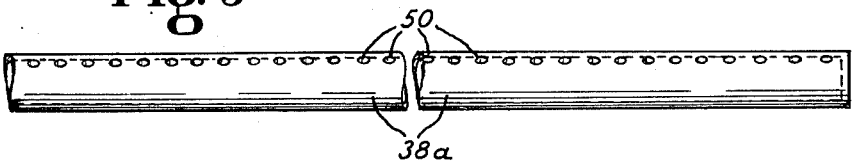
FIG. 5 is a fragmentary elevational view of a modified air supplying distributor.

As best seen in FIG. 4, the slot port 40 for each of the delivery ducts 38, and by the same token for the delivery ducts 39, extends throughout substantially the width of the trim chute 10. If preferred, the slot means in the ducts 38 and 39 may, as shown in FIG. 5, comprise a plurality of ports 50 extending in a longitudinal row through the wall of the duct **38*a* throughout substantially the same length of the duct as the slot port 40 extends in the duct 38. Each of the ports 50 may be of a diameter equal to the width of the slot port 40, and the number of the ports 50 and their spacing are desirably such as to, in effect, deliver the same uniform volume of air as the slot port 40. Any turbulence that may be experienced when delivering the air through the row of ports 50 will be modulated in the respective chamber 37 so that the air issuing through the associated orifice slot 32** will be smooth and substantially uniform.

Referring now to FIGS. 1 and 2, air from source is supplied to the ducts 38, 39 and **38*a* through suitable manifold means. For example, a manifold 51 may communicate through respective connecting lines 52 with the ducts 39. A manifold 53 may communicate through respective lines 54 with the ducts 38. In order to attain utmost desired control of air pressure for each of the ducts 38 and 39, the respective connections 52 and 54 are each provided with a control valve 55. Each of the valves 55 may be individually operable to adjust the air pressure in its associated duct 38 or 39 without regard to any of the control valves, or all of the valves may be integrated in a common system for automatic regulation wherein each of the valves may be adjustable to regulate the air pressure for its associated duct 38 or 39 individually, or by aligned pairs of the ducts 38 and 39 on opposite sides of the trim strip passageway 21, or to maintain a graduated pressure differential between the ducts 38 at one side of the passageway and the ducts 39 at the opposite side of the passageway, or to effect a graduated or progressive pressure differential within the ducts of either bank of ducts, that is the ducts 38 or the ducts 39 considered as a bank, or any combination of these regulations, as may be desired for utmost efficiency in operation. In any event, smoothly running air lubricated or cushioned and onwardly or downstream biased travel of the trim strip T between the air cushions or lubricating layers schematically indicated by the directional arrows in FIG. 3** is attained.

It will be understood that variations and modifications may be effected without departing from the spirit and scope of the novel concepts of this invention.

I claim as my invention:

1. A trim chute assembly for receiving trim strip severed by a slitter from the margin of a travelling web, comprising:

chute means defining a generally downwardly extending passageway for guiding the trim strip along a path downwardly away from the slitter;

said chute means having opposed spaced passageway-defining wall surfaces between which the trim strip is adapted to pass freely downwardly in the passageway;

and means for supplying low velocity air downwardly and biasing the air generally toward and then to flow downwardly along said wall surfaces with enhanced coanda effect and providing cushioning, lubricating air layers which move substantially parallel to the direction of travel of the trim strip and at a controlled velocity about the same as the speed of travel of the travelling web so that as the air layers move downwardly along said path between said chute means wall surfaces and both of said opposite faces of the trim strip flotation of the strip downwardly in the passageway free from contact with said surfaces is effected and movement of the strip away from the slitter along said path is facilitated.

2. An assembly according to claim 1, including means for enhancing the coanda effect of said air layers along said chute means.

3. An assembly according to claim 1, including mechanical baffle means for guiding the trim strip from the slitter into said passageway.

4. An assembly according to claim 1, wherein said means for supplying low velocity lubricating air layers along said path comprises a plurality of orifice slots extending across the width of said path opposite both opposite faces of the trim strip, said orifice slots being located at successive spaced intervals downstream in said passageway and said chute means passageway becoming progressively wider in downstream direction for thereby accommodating increased volume of air in the passageway without turbulence.

5. An assembly according to claim 4, comprising means for delivering substantially stabilized air supply to said orifice slots.

6. An assembly according to claim 1, wherein said passageway arches away and downwardly from where the trim strip is received from the slitter, to facilitate substantial conformance of the lubricating air layer to normal high speed downwardly arching movement of the trim strip along said path.

7. An assembly according to claim 1, including means for selectively controlling the velocity of air supplied to said lubricating air layers.

8. An assembly according to claim 1, wherein said means for supplying low velocity lubricating air layers comprise air supplying orifice slots extending across the width of the chute means, and means defining said slots for directing the air from the slots downstream with respect to the direction of movement of said trim strip along said path and for biasing the air generally toward said wall surfaces for enhancing coanda effect.

9. An assembly according to claim 8, wherein convergently related plate members cooperate to define air distribution chambers upstream from and extending along said orifice slots.

10. An assembly according to claim 9, including manifold ducts extending along and supplying air to said chambers.

11. An assembly according to claim 10, wherein said ducts extend entirely across the upstream ends of said chambers and have port means substantially uniformly delivering air to said chambers.

12. An assembly according to claim 11, wherein said duct port means comprise longitudinal slots of greater width than the width of said orifice slots.

13. An assembly according to claim 11, wherein said port means comprise a series of individual ports extending longitudinally along said ducts and of greater cross sectional flow area than said orifice slots.

14. An assembly according to claim 8, including turned orifice slot edge means for enhancing the coanda effect for said air layers downstream from said orifice slots.

15. A method of facilitating movement in a generally downwardly extending trim chute passageway of trim strip severed by a slitter from the margin of a travelling web, comprising:

guiding the trim strip away from the slitter along a downward path in said passageway;

along said path supplying low velocity air in downward direction and biasing the air generally toward and to flow along spaced wall surfaces defining said passageway and spaced from the respective opposite faces of the trim strip moving downward along said path;

controlling the air in the form of cushioning and lubricating air layers along and between said faces of the trim strip and said wall surfaces and thereby effecting floatation of the strip and facilitating movement of the strip along said path and away from the slitter;

and biasing the air in said layers generally toward and then to flow along said wall surfaces and thereby enhancing coanda effect in the downwardly moving air layers.

16. A method according to claim 15, comprising supplying air to said air layers at successive intervals downstream along said path and biased at each interval downwardly and toward said surfaces for enhancing coanda effect of the air layers.

17. A method according to claim 15, which comprises supplying said air to said layers through orifice slots extending across said path and along surface areas curved toward the respective slots.

18. A method according to claim 17, comprising delivering air to said orifice slots through air distribution chambers extending therealong upstream from said orifice slots, and supplying air to said chambers from manifolds extending along said chambers and through slot ports of larger flow area than said orifice slots.

19. A method according to claim 17, comprising selectively controlling air velocity to said orifice slots.

20. A method according to claim 15, comprising absorbing undesirable sound generated in said passageway.

21. A method according to claim 15, which comprises biasing said trim strip in movement along said path by action of said air layers, and modulating the air before it is supplied to said layers and thereby suppressing any turbulence that might otherwise be transmitted to said air layers.

22. A trim chute assembly for receiving trim strip severed by a slitter from the margin of a travelling web, comprising:

chute means defining a generally downwardly extending passageway for guiding the trim strip along a path downwardly away from the slitter;

said chute means having opposed spaced passageway-defining wall surfaces between which the trim strip is adapted to pass freely downwardly in the passageway;

means for supplying low velocity air downwardly and biasing the air generally toward and then to flow downwardly along said wall surfaces with enhanced coanda effect and providing cushioning, lubricating air layers which move substantially parallel to the direction of travel of the trim strip and at a controlled velocity about the same as the speed of travel of the travelling web so that as the air layers move downwardly along said path between said chute means wall surfaces and both of said opposite faces of the trim strip flotation of the strip downwardly in the passageway free from contact with said surfaces is effected and movement of the strip away from the slitter along said path is facilitated;

said air supplying means comprising manifolds extending across and parallel to the path of movement of said trim strip and behind said wall surfaces;

said manifolds having air delivery port means therealong directed generally downwardly;

plate means coacting with said manifolds and defining distribution and air modulating chambers into which said port means discharge air from the manifolds;

and orifice slots defined by said plates at said wall surfaces, and the air for said air layers issuing from said orifice slots.

23. A trim chute assembly according to claim 22, wherein said plates comprise in association with each of said manifolds an inner plate and an outer plate having regard to said passageway, the inner plate overlapping the outer plate, said outer plate projected to a substantial extent downstream from the adjacent end of the inner plate, the inner plate having an edge cooperating with an intermediate area of the outer plate to define the associated orifice slot, and said plates being shaped to effect said biasing of the air generally toward and downwardly along said wall surfaces for enhancing the coanda effect.

* * * * *